US006589138B2

(12) United States Patent
Dyer et al.

(10) Patent No.: US 6,589,138 B2
(45) Date of Patent: Jul. 8, 2003

(54) TREADMILL CUSHION

(75) Inventors: David Dyer, Renton, WA (US); Patrick J. Waite, Snohomish, WA (US); Chris Klemczyk, Bothell, WA (US)

(73) Assignee: Precor Incorporated, Woodinville, WA (US)

( * ) Notice: Subject to any disclaimer, the term of this patent is extended or adjusted under 35 U.S.C. 154(b) by 28 days.

(21) Appl. No.: 09/858,876

(22) Filed: May 11, 2001

(65) Prior Publication Data

US 2002/0010055 A1 Jan. 24, 2002

Related U.S. Application Data

(60) Provisional application No. 60/203,651, filed on May 12, 2000.

(51) Int. Cl.[7] ..... A63B 22/00
(52) U.S. Cl. ..... 482/54; 482/51
(58) Field of Search ..... 482/51, 54

(56) References Cited

U.S. PATENT DOCUMENTS

| | | | | |
|---|---|---|---|---|
| 5,279,528 | A | 1/1994 | Dalebout et al. | |
| 5,336,144 | A | 8/1994 | Rodden | |
| 5,382,207 | A | 1/1995 | Skowronski et al. | |
| 5,441,468 | A | 8/1995 | Deckers et al. | |
| 5,454,772 | A | 10/1995 | Rodden | |
| 5,599,259 | A | 2/1997 | Skowronski et al. | |
| 5,673,930 | A | 10/1997 | Coleman | |
| 5,704,879 | A | 1/1998 | Watterson et al. | |
| 5,860,893 | A | 1/1999 | Watterson et al. | |
| 5,993,358 | A | 11/1999 | Gureghian et al. | |
| 6,013,011 | A | 1/2000 | Moore et al. | |
| 6,045,490 | A | 4/2000 | Shafer et al. | |
| 6,280,362 | B1 * | 8/2001 | Dalebout et al. | 482/54 |

FOREIGN PATENT DOCUMENTS

| | | |
|---|---|---|
| EP | 0 956 884 A1 | 11/1999 |

* cited by examiner

*Primary Examiner*—Glenn E. Richman
(74) *Attorney, Agent, or Firm*—Christensen O'Connor Johnson Kindness pllc

(57) ABSTRACT

A treadmill (10) includes a frame (12) on which are rotatably mounted first and second transverse roller assemblies (14, 16). An endless belt (18) is trained around the roller assemblies. A deck (20) is supported between the upper run of the belt and the frame by a plurality of rectilinear-shaped elastic cushions 100 that are reversibly deformable under the load imposed on a deck by the footplant of the treadmill user. The cushions 100 are not of uniform cross-section; rather, one or both of the ends of the cushions are relieved so as to present a nominally reduced cross-sectional area against the frame and/or deck. As the cushion is compressed from the load imposed on the deck, the cross-sectional area of the cushion providing resistance to further deformation/deflection of the cushion increases thereby increasing the resistance or stiffness of the cushion to further deformation and thus further travel of the treadmill deck (20) towards the frame (12).

19 Claims, 4 Drawing Sheets

TREADMILL CUSHION

CROSS-REFERENCE TO RELATED APPLICATION

This application claims the benefit from U.S. Provisional Patent Application Serial No. 60/203,651 filed May 12, 2000, the disclosure of which is hereby expressly incorporated by reference.

FIELD OF THE INVENTION

The present invention relates to cushions for exercise devices having a deck supported by a frame of the exercise device, and more particularly to exercise treadmills having a deck supported by the frame of the treadmill.

BACKGROUND OF THE INVENTION

Conventional treadmills typically include a first and second roller assemblies rotatably mounted across opposite ends of a frame. An endless belt is trained about the roller assemblies. The upper run of the belt is supported by and slides over a deck disposed between the frame and the upper run of the belt.

Exercise treadmills now commonly seek to cushion, at least somewhat, the shock loads imposed on the exerciser's feet during walking or running on the treadmill. In some of these treadmills, the deck is mounted on the frame using a shock absorbing mechanism. Such shock absorbing mechanisms may involve placing blocks or pads of elastic material or springs between the deck and the frame to seek to absorb the shock and reduce impact loads on the runner. However, many of these designs do not perform equivalently for exercisers of differing weights. Elastic blocks, pads or springs sized to deform sufficiently under the impact of an exerciser of relatively low weight may not sufficiently absorb the impact resulting from the foot plant of a larger, heavier person. Similarly, if the elastic blocks, pads or springs are of sufficient size and stiffness to adequately cushion and protect a heavier exerciser, they may not compress sufficiently under the weight of a lighter-weight exerciser, and therefore not provide sufficient cushioning for such smaller exercisers.

Therefore, a need exists for treadmill cushions that provide adequate cushioning for exercisers of a wide range of weights.

SUMMARY OF THE INVENTION

The present invention provides an exercise treadmill, including the frame, first and second roller assemblies rotatably mounted on the frame, and an endless belt trained about the first and second roller assemblies. The exercise treadmill include a deck disposed between the frame and the upper run of the belt. Elastomeric cushions or spring members are disposed between the deck and the frame for supporting the deck spaced from the frame. Elastomeric cushions reversibly deform to resist deflection of the deck toward the frame when an exerciser strides on the belt, with the resistance provided by the elastomeric cushions being related to the deflection of the deck.

In a further aspect of the present invention the elastomeric spring members are configured so that the cross-sectional area of the cushions increases from one or both ends in the direction towards the opposite end. Such a change in cross-sectional area of the end portions of the cushions occurs along a predetermined length of the cushion.

In a further aspect of the present invention, the intersection of one or both of the end portions of the cushion with the exterior surface of the cushion is relieved; for example, by radiusing, chamfering, or beveling.

In a further aspect of the present invention, an aperture extends into the cushion from the first and/or second end portions of the cushion, and a retainer projects from one or both of the frame and deck to closely engage within the aperture(s) for retention of the cushion.

In accordance with a further aspect of the present invention, the shape of the aperture(s) of the cushion is selected from a group consisting of round, oblong, oval, square, rectangular, triangular, pentagonal, hexagonal, and octagonal. Also in accordance with a further aspect of the present invention, the cross-sectional shape of the retainer may be circular, oval, triangular, square, pentagonal, hexagonal or octagonal.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
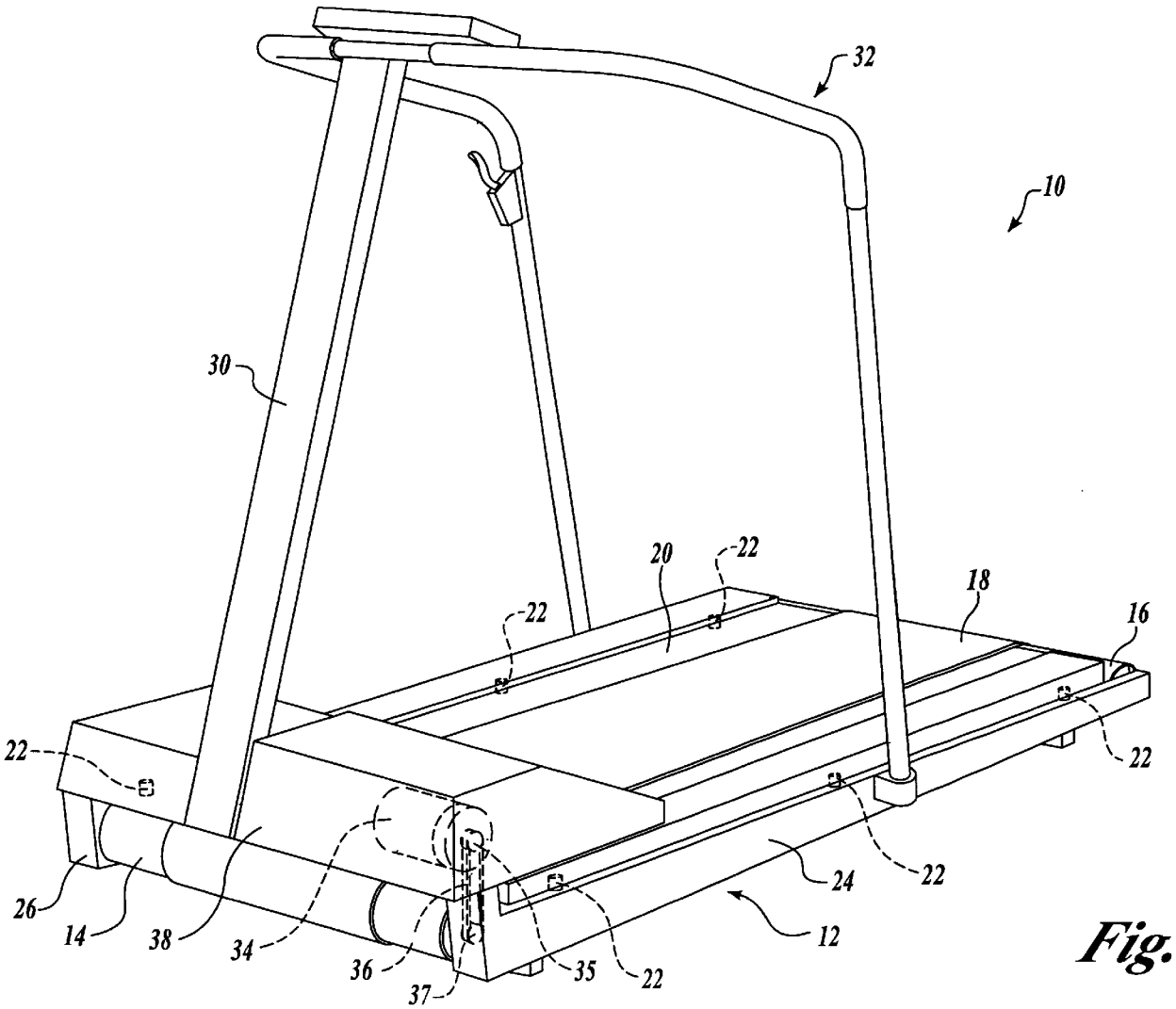
FIG. 1 provides a pictorial view of a standard treadmill known in the art provided for illustrative purposes.

FIG. 1 illustrates one non-limiting example of a treadmill 10 known in the art. While an embodiment of a treadmill is supplied in this application for illustrative purposes, it should be apparent that alternate treadmill configurations utilizing treadmill cushions are also within the scope of the claimed invention. The treadmill 10 in FIG. 1 includes a frame 12 having longitudinal side members 24 and 26. At the opposite ends of the frame 12, are transversely mounted a forward roller assembly 14 and a rear roller assembly 16. An endless belt 18 is trained about the forward roller assembly 14 and the rear roller assembly 16. A deck 20 is disposed between the upper run of the belt 18 and the frame 12. The deck 20 is supported by a plurality of treadmill cushions 100 which may be positioned between the deck 20 and the frame 12. When an individual exercises on the treadmill 10, the plurality of cushions 100 located between the frame 12 and the deck 20 compress to absorb and/or dampen the impact load imposed on the exerciser's feet at foot plant.

Figure 2:
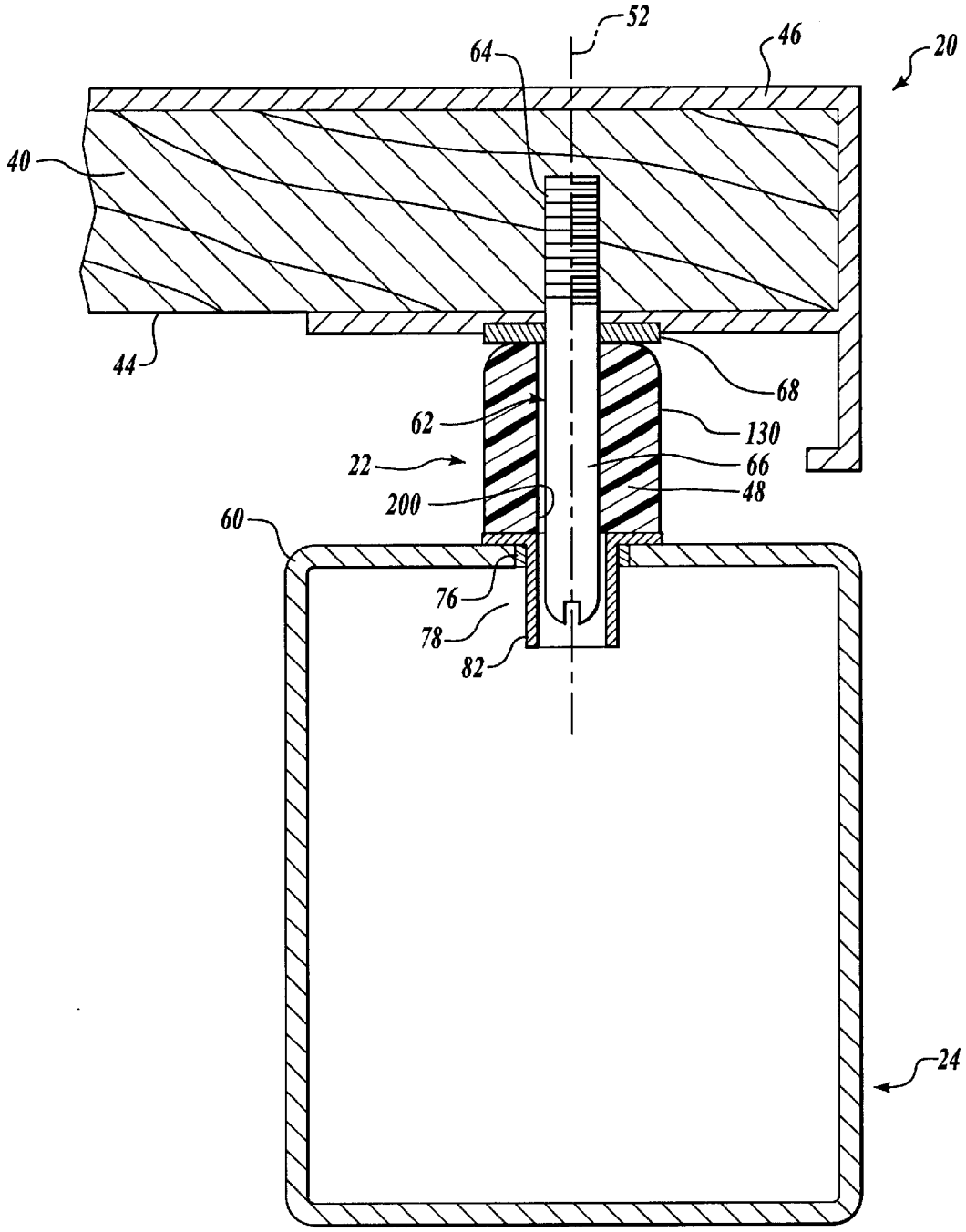
FIG. 2 provides a cross-sectional detailed view of a treadmill cushion installed in one embodiment of a standard treadmill.

In a preferred embodiment, the treadmill cushions 100 may each be held in place by at least one pin or stud 62 or other type of retainer. FIG. 2 illustrates one non-limiting example of a possible configuration of a cushion retainer utilizing a stud 62 to retain the cushions 100. While an embodiment of a cushion retainer is supplied in this application for illustrative purposes, it should be apparent that alternate cushion retainer configurations are also within the scope of the claimed invention. As one non-limiting example of another cushion retainer, multiple studs could retain a single cushion. As another non-limiting example of a cushion retainer, recesses could be formed in the deck 20 and/or in the frame 12, such that the cushion 100 may be received in and held in place by either recess.

Referring to FIG. 2, each stud 62 includes an upper threaded portion 64 and a lower non-threaded portion 66. An annular flange 68 is formed on the stud 62 between the upper threaded portion 64 and the lower non-threaded portion 66. The upper threaded portion 64 of each stud 62 is threaded into the underside of the deck 20 until the flange 68 bears against the underside of the deck 20. To prevent the flange 68 from interfering with the proper functioning of the cushions 100, it is preferable to have the flange 68 received into a shallow recess in the underside of the deck 20 and/or have the flange 68 appropriately shaped and sized large enough such that the entire top surface of the cushion 100 bears against the flange 68. The non-threaded portion 66 of the stud 62 thus projects substantially orthogonally downward from the underside of the deck 20.

Figure 3:
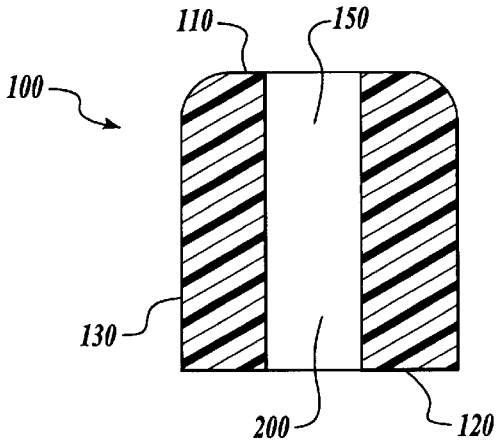
FIG. 3 is a longitudinal cross-sectional view of the treadmill cushion shown in FIG. 2.

Referring to FIGS. 2 and 3, a hole 200 approximately centered on the central axis 52 is formed through each cushion 100 in one embodiment of the invention. A plurality of spaced apertures 76 may be formed through the top side 60 of each longitudinal side member 24 and 26 of the frame 12 at locations corresponding to the positioning of the cushions 100. A grommet or bushing 78 may be installed within each aperture 76 to serve as a guide for the stud 62. As shown in FIG. 2, the internal diameter of the sleeve portion 82 of each bushing 78 is preferably slightly larger than the external diameter of the lower non-threaded portion 66 of each stud 62. The bushings 78 are preferably formed from a substantially rigid, low-friction material, such as a polyamide plastic.

As shown in FIGS. 1 and 2, the deck 20 of the treadmill 10 is preferably not rigidly connected to the frame 12, and is at least partially supported above the frame 12 by the cushions 100. The studs 62 may act as guide members to prevent undesirable movement of the deck 20 in the forward and aft and side-to-side directions, but do not provide a rigid interconnection between the deck 20 and frame 12. When an exerciser lands on the belt 18 of the treadmill 10, the deck 20 is deflected downwardly toward the frame 12, this deflection being resisted by compression of the cushions 100. The cushions 100 act to absorb the shock load caused by the impact of the exerciser's feet on the deck. After each impact of an exerciser on the treadmill deck 20, the cushions 100 preferable are capable of returning to their initial configuration before the next footfall.

The structure of one embodiment of the cushion 100 will now be described while referring specifically to FIGS. 3, 4 and 6. FIG. 3 illustrates a longitudinal cross-section of a cushion 100 constructed in accordance with one embodiment of the present invention. The cushion 100 includes a top end 110, bottom end 120, and an external sidewall 130. The cushion 100 is illustrated as being generally cylindrical in form. However, it is apparent to one of ordinary skill in the art that numerous shapes extended over a predetermined distance can yield an acceptable form. Therefore, many rectilinear or other shapes can substitute for the cylindrical shape shown and fall within the scope of the present invention. In the preferred embodiment, the outside sidewall 130 of the cushion 100 has a length measured along the longitudinal axis of between about 1.0 and 2.5, and preferably about 1.5 inches.

Figure 4:
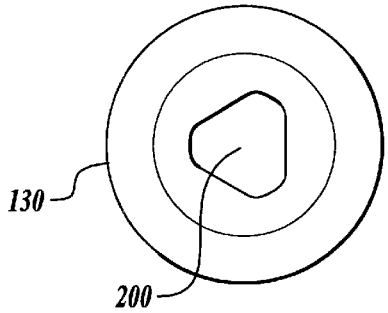
FIG. 4 is a top view of the treadmill cushion shown in FIG. 2.

FIG. 4 illustrates a transverse cross-section of one preferred embodiment of the cushion 100. In the cross-section shown in FIG. 4, the cushion 100 is illustrated as generally circular in shape; however, as mentioned above, many other shapes such as oval, polygonal, or free form, can serve for the purpose of the present invention and are also within the scope of the present invention. In the preferred embodiment, the width or diameter of the cushion ranges from about between 1.30 inches to 2.00 inches, and is preferably about 1.40 inches.

In one embodiment of the present invention, a hole 200 extends longitudinally through, or at least partially through, the longitudinal center of cushion 100. In the preferred embodiment, the hole 200 preferably has a cross-sectional area equal to or greater than the cross-sectional area of the stud 62 to receive the stud therein. While a single hole 200 is depicted in FIGS. 2 and 3, it should be apparent to one of ordinary skill in the art that a plurality of holes may be substituted for the single hole 200, and is within the scope of the present invention. Cushion 100 may be designed to receive more than one stud 62 or other retention mechanism or member(s) designed to maintain the position of the cushion 100 relative to the frame 12 and/or deck 20. Furthermore, the hole 200 need not necessarily extend through the entire length of the cushion 100. Cushion 100, including a hole or plurality of holes that extends only through a portion of the length/height of cushion 100 along its longitudinal axis, is also within the scope of the invention.

As depicted in FIG. 4, in lateral cross-section the hole 200 can be generally triangular in shape. However, it should be apparent to one of ordinary skill in the art that alternate shapes capable of receiving the stud 62 are also within the scope of the invention. For example, the hole 200 in cross-section can also be circular (see FIG. 6), oval, oblong, elliptical, square, rectangular, pentagonal, hexagonal, octagonal, etc.

While the stud 62 preferably may have a generally circular cross-sectional shape, the cross-sectional shape of the stud 62 need not be circular. As a non-limiting example, the cross-sectional shape of the stud 62 could be oval, triangular, pentagonal, hexagonal, or any polygonal shape, or other shape.

In the preferred embodiment, the hole 200 preferably has a different cross-sectional shape than the cross-sectional shape of the stud 62. Furthermore, it is preferable that when the stud 62 is placed inside the hole 200, at lease one gap exists between the inside wall 150 and the stud 62 to reduce or eliminate the generation of adhesion or suction forces between the stud 62 and the inside wall that can cause the cushion 100 to move longitudinally relative to the stud 62 and perhaps become disengaged from the stud.

In a preferred embodiment, the juncture between one or both of the ends of the cushion and its outside wall 130 and/or inside wall 150 may be radiused, beveled, chamfered, or otherwise relieved. In FIG. 3 the intersection between the outside wall 130 and the top end 110 of the cushion 100 is radiused. However, the intersection between the outside wall and the top end 110 and/or bottom end 120 of the cushion 100 could also be radiused, beveled, or chamfered. Additionally, the intersection between the inside wall 150 of the cushion 100 and the top end 110 and/or bottom end 120 could also be radiused, beveled, chamfered, or otherwise relieved.

In a preferred embodiment, the extent of the radiusing, beveling, chamfering, or other relieving employed may be within a range of between approximately 10% and 30% and preferably may be approximately 16.6% of the length of the cushion 100 along its longitudinal axis. Furthermore, in a preferred embodiment, the size of the radiusing, beveling, chamfering, or other relieving employed is preferably within a range of between approximately 10% and 30% and preferably approximately 18% of the diameter or width of the cushion 100 along its transverse axis.

Radiusing, beveling, and chamfering are non-limiting methods of reducing the cross-sectional area of the cushion 100 at its top 110 or bottom 120 portions. Consequently the cushion 100 has a slightly greater cross-sectional area spaced from its top 110 and/or bottom 120 end than at the ends themselves.

Downward deflection of the deck 20 toward the frame 12 results in axial compression of the cushions 100. When the cushion 100 is being initially compressed, the resistance to compression of the cushion 100 varies because of the reduction of cross-sectional area at the top 110 and/or bottom 120 ends of the cushion 100. As the compression of the cushion 100 increases, the surface area of contact available to resist further compression or deflection increases between the cushion 100 and the deck 20 and/or frame 12 at the end(s) of the cushion 100 that has/have been radiused, beveled, chamfered, or otherwise relieved.

Figure 5:
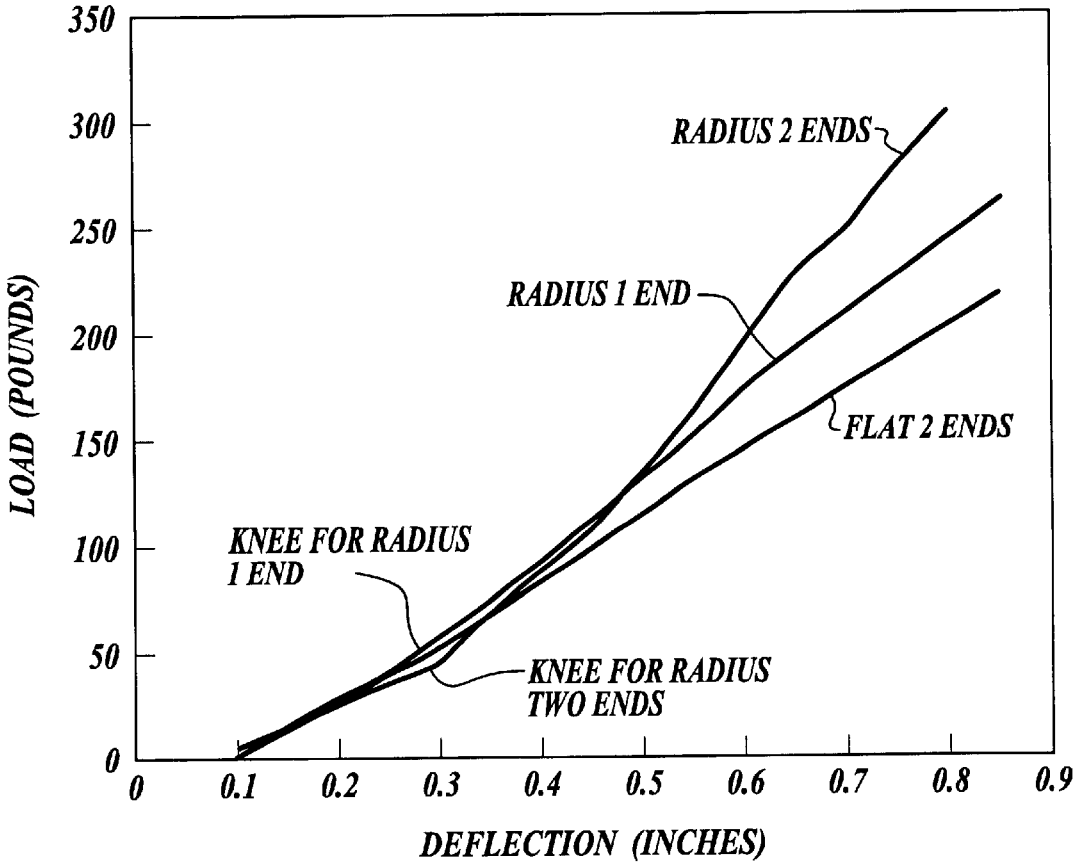
FIG. 5 is a chart depicting the relationship between load and deflection for two embodiments of the treadmill cushion constructed in accordance with the present invention and a treadmill cushion in which neither intersection between the sidewall and the ends is relieved.

The chart in FIG. 5 shows the deflection of three cushions when load is applied. The three cushions include: 1) a cushion not radiused or otherwise relieved on either intersection between the sidewall and the ends of the cushion; 2) a cushion radiused on one of the intersections between the outside sidewall 130 and one end of the cushion in accordance with the present invention; and 3) a cushion radiused on both intersections between the outside sidewall 130 and both ends of the cushion in accordance with the present invention.

The stiffness of each cushion can be calculated for each level of load by dividing the load by the deflection. Referring to FIG. 5, the stiffness of the cushion without any radiusing remains approximately constant as load is applied. (In FIG. 5, the abscissa [deflection magnitude] is shifted 0.1 inch to the right). However, the stiffness of the cushion with radiusing on one of the intersections between the outside sidewall and one end of the cushion varies as the load is applied to the cushion. In some embodiments of the cushion 100, radiusing one of the intersections between the sidewall and one end of the cushion has been found to produce two different stiffnesses per unit deflection of the cushion. For example, when one such cushion is compressed about one third inch, the cushion exhibits a stiffness that is about 55 percent of the stiffness that occurs as the cushion is further compressed.

Still referring to FIG. 5, radiusing both intersections between the outside sidewall 130 and both ends of the cushion 100 may further affect the relationship between load and deflection. According to FIG. 5, radiusing both intersections has been found to produce more than two different stiffnesses per unit deflection of the cushion 100. One change in stiffness may occur at approximately 0.20 inch of deflection. A second change in stiffness may occur at approximately 0.35 inch of deflection. A third change in stiffness may occur at approximately 0.55 inch of deflection.

The chart in FIG. 5 also shows that radiusing one or more ends on the cushion results in lesser deflection of the cushion per unit load applied to the cushion for loads greater than approximately 75 pounds.

In the preferred embodiment the cushion 100 is constructed of a suitably elastic material such as urethane. Other materials could include natural rubber, nitrile and polychloroprene rubbers. In the preferred embodiment the material has a hardness ranging from approximately 30 durometer shore A to 60 durometer shore A and is preferably within the range of approximately 37 durometer shore A to 43 durometer shore A.

Figure 6:
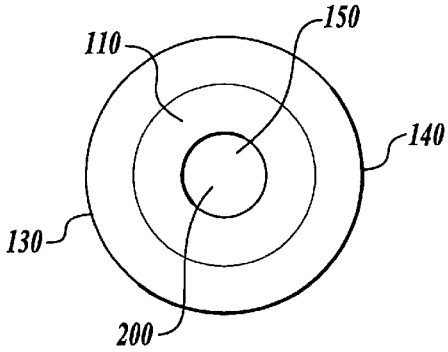
FIG. 6 is a top view of a second embodiment of a treadmill cushion constructed according to the present invention.
Figure 7:
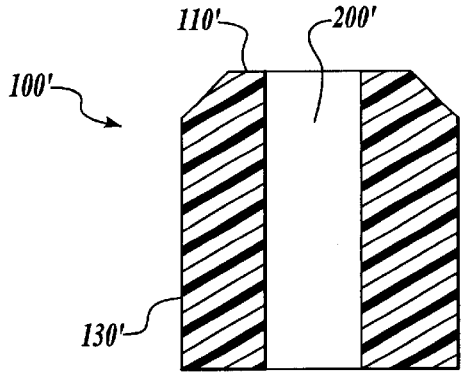
FIG. 7 is a longitudinal cross-sectional view of a further embodiment of the present invention.

A further preferred embodiment to the present invention is illustrated in FIG. 6 wherein the cushion 100' is illustrated as being similar in construction to cushion 100, described above, but with the center hole extending longitudinally through the cushion being round in cross-section rather than triangular as shown in FIGS. 3 and 4. In all other respects, the cushion 100' is constructed the same as cushion 100.

While preferred embodiments of the invention has been illustrated and described, it will be appreciated that various changes can be made therein without departing from the spirit and scope of the invention.

The embodiments of the invention in which an exclusive property or privilege is claimed are defined as follows:

1. An exercise treadmill comprising:

a. a frame;

b. first and second roller assemblies rotatably mounted on the frame;

c. an endless belt trained about the first and second roller assemblies;

d. a deck disposed between the frame and an upper run of the belt;

e. a plurality of elastic cushions, for supporting the deck spaced apart from the frame;

f. said cushions being generally rectilinear in shape and having an outside surface, a first end portion and a second end portion spaced from the first end portion, the load from the deck acting on one of the end portions of the cushions and the reaction load from the frame acting in the opposite end portion of the cushions; and g. wherein said cushions having portions defining an aperture extending along the cushions in the direction between the first end portion and the second end portion of the cushions; and h. wherein the juncture between the outside surface of the cushions and one of the first end and second end portions is relieved.

2. The exercise treadmill of claim 1, wherein the relief selected is from a group consisting of a radius, chamfer and bevel.

3. The exercise treadmill of claim 1, wherein the junctures of the outside surface and one of the first and second portions are radiused, chamfered or beveled.

4. The exercise treadmill of claim 1, wherein the aperture extending along the cushion between the first and second ends of the cushion comprising a through bore extending substantially centrally through the cushion.

5. The exercise treadmill of claim 4, wherein the cross-sectional shape of the through bore is selected from a group consisting of round, oblong, oval, square, rectangular, triangular, pentagonal, hexagonal, and octagonal.

6. The exercise treadmill in claim 4, wherein the through bore has an inside surface and the juncture between the inside surface and the first or second end of the cushion is radiused, chamfered, or beveled.

7. The exercise treadmill of claim 6, wherein the cross sectional shape of the through bore is selected from a group consisting of round, oblong, oval, square, rectangular, triangular, pentagonal, hexagonal, and octagonal.

8. The exercise treadmill of claim 7, wherein the through bore has an inside surface and the juncture between the inside surface and at least one of the first and second end portions is radiused, chamfered, or beveled.

9. The exercise treadmill of claim 8, further comprising at least one retainer projecting outwardly from one of the deck or frame to be closely slidably receivable within a receiving opening in the other of the deck or frame, said retainer being slidably received inside the through bore of the cushion.

10. The exercise treadmill of claim 4, wherein the through bore has an inside surface and the juncture between the inside surface of the through bore and one of the first and second ends of the cushion is radiused, chamfered, or beveled.

11. The exercise treadmill of claim 10, wherein the cross sectional shape of the aperture is selected from a group consisting of round, oblong, oval, square, rectangular, triangular, pentagonal, hexagonal, and octagonal.

12. An exercise treadmill comprising:

a. a frame;

b. a substantially rigid deck supported by the frame; and c. a plurality of elastic cushions each comprising:

i. a longitudinally rectilinear shaped cushion having a first end, a second end, and a cross-sectional area that increases from the first end to a predetermined location along the longitudinal axis of the cushion ii. wherein the plurality of elastic cushions deform to resist deflection of the deck toward the frame resulting from loads imposed on the deck d. wherein the elastic cushions have at least one aperture extending therein from at least one of the first and second ends; and e. further comprising a retainer extending from one of the frame and deck and sized to be closely engaged within the cushion aperture for retention of the cushion thereon.

13. The exercise treadmill of claim 12, wherein the cross-sectional area increases from the second end to a predetermined point along the longitudinal axis.

14. The exercise treadmill according to claim 12, wherein the cross-sectional shape of the aperture of the cushion is selected from a group consisting of round, oblong, oval, square, rectangular, triangular, pentagonal, hexagonal and octagonal.

15. An exercise treadmill according to claim 12, wherein the cross-sectional shape of the retainer is selected from a group consisting of circular, oval, triangular, square, pentagonal and hexagonal.

16. In an exercise apparatus, including frame and a platform on which various exercises are performed by a user, the platform supported by the frame, an improvement comprising a plurality of elastic cushions positioned between the deck and the frame, said cushions being generally rectilinear in shape and having a first end portion, a second end portion spaced from the first end portion, and an exterior surface, the load from the deck acting on one of the end portions of the cushion and the reaction load from the frame action on the other end portion of the cushion, wherein cross-sectional area of the cushion adjacent the first and second end portion varying in area in the direction toward the opposite end portion of the cushion, thereby presenting a changing bearing area to the frame and the deck as the cushion is deformed to resist loads imposed on the deck during use of the exercise apparatus.

17. An improvement according to claim 16, wherein the juncture between the outside surface of the cushion and one or more of the first and second end portions are radiused, chamfered or beveled.

18. An improvement according to claim 16, wherein the cushions have at least one aperture extending therein from at least one of the first and second end portions of the cushions; and, further comprising a retainer projecting from one or both of the frame and deck, said retainer sized to be closely engageable within the cushion aperture for retention of the cushion.

19. The improvement according to claim 18, wherein:

the cross-sectional shape of the aperture of the cushion is selected from a group consisting of round, oblong, oval, square, rectangular, triangular, pentagonal, hexagonal, and octagonal; and, the cross-sectional shape of the retainer is selected from a group consisting of circular, oval, triangular, pentagonal, hexagonal, and octagonal.

* * * * *